US009994436B2

(12) United States Patent
Leibinger

(10) Patent No.: US 9,994,436 B2
(45) Date of Patent: Jun. 12, 2018

(54) DEVICE FOR FILLING A RECEPTACLE

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 66 days.

(21) Appl. No.: 15/101,933

(22) PCT Filed: Nov. 25, 2014

(86) PCT No.: PCT/EP2014/003140
§ 371 (c)(1),
(2) Date: Jun. 6, 2016

(87) PCT Pub. No.: WO2015/082055
PCT Pub. Date: Jun. 11, 2015

(65) Prior Publication Data

US 2016/0311672 A1 Oct. 27, 2016

(30) Foreign Application Priority Data

Dec. 6, 2013 (DE) ..... 10 2013 022 261

(51) Int. Cl.

| | |
|---|---|
| ***B67C 3/04*** | (2006.01) |
| ***B65B 3/00*** | (2006.01) |
| ***B67C 3/02*** | (2006.01) |
| ***B67C 9/00*** | (2006.01) |
| ***B65B 31/00*** | (2006.01) |
| ***B65B 69/00*** | (2006.01) |

(52) U.S. Cl.
CPC ..... *B67C 3/04* (2013.01); *B65B 3/00* (2013.01); *B65B 31/00* (2013.01); *B65B 69/005* (2013.01); *B67C 3/02* (2013.01); *B67C 9/00* (2013.01)

(58) Field of Classification Search
CPC .... B67C 3/02; B67C 3/04; B67C 9/00; B65B 3/00
USPC ..... 141/114, 314, 316; 222/92, 95, 386.5
See application file for complete search history.

(56) References Cited

U.S. PATENT DOCUMENTS 4,241,768 A * 12/1980 Keller ..... A61J 9/001 141/313
4,387,833 A * 6/1983 Venus, Jr. ..... B65D 83/0061 222/105
4,809,884 A * 3/1989 Stackhouse ..... B67D 1/045 222/153.04
5,137,179 A * 8/1992 Stoffel ..... B65D 83/62 215/3
5,505,039 A * 4/1996 Maier ..... B65B 31/00 141/20

(Continued)

FOREIGN PATENT DOCUMENTS

| | | |
|---|---|---|
| DE | 1 199 649 | 8/1965 |
| JP | H11 334798 A | 12/1999 |
| JP | 2011 093610 A | 5/2011 |

*Primary Examiner* — Timothy L Maust
(74) *Attorney, Agent, or Firm* — Gudrun E. Huckett

(57) ABSTRACT

A device for filling a receptacle (1) with a liquid, especially a drinking liquid, comprises a balloon-type body (4) which can be introduced into an opening (3) in the receptacle (1) and can be filled and inflated in such a way that the balloon-type body (4) rests against the inner surface of the inflated, the balloon-type body (4) is folded about the circumference in order to increase the size of the circumferential line of the balloon-type body (4) compared to a simple circle.

8 Claims, 3 Drawing Sheets

(56) References Cited

U.S. PATENT DOCUMENTS

| | | | | |
|---|---|---|---|---|
| 6,196,275 | B1 * | 3/2001 | Yazawa | B65B 31/003 141/18 |
| 7,395,949 | B2 * | 7/2008 | Ehret | B67D 1/045 215/231 |
| 8,061,393 | B2 * | 11/2011 | Behar | B65B 3/16 141/20 |
| 8,196,620 | B2 * | 6/2012 | Fransen | B65D 83/62 141/10 |
| 8,561,853 | B2 * | 10/2013 | De Mei | B65D 79/005 222/153.04 |
| 8,596,478 | B2 * | 12/2013 | Gadzic | B65D 47/265 141/320 |
| 9,033,185 | B2 * | 5/2015 | Nimmo | B65D 83/62 222/1 |
| 9,452,875 | B2 * | 9/2016 | Jepson | B65D 81/245 |
| 9,701,430 | B2 * | 7/2017 | Smith | B65B 31/025 |
| 2009/0095776 | A1 | 4/2009 | Turner et al. | |

* cited by examiner

DEVICE FOR FILLING A RECEPTACLE

BACKGROUND OF THE INVENTION

The invention concerns a device for filling a receptacle with a liquid, intended in particular for consumption, comprising a balloon-type body arranged at a holder and liquid-tight relative to the liquid as well as gas-tight, wherein the balloon-type body is insertable into an opening of the receptacle and the holder is secured on or in the opening of the receptacle after complete insertion, and wherein after insertion the balloon-type body is fillable and inflatable with an expansion medium in such a way that the balloon-type body contacts the inner wall surface of the receptacle.

For filling a receptacle, in particular bottle, with a liquid intended for consumption, in particular beverage, a balloon-type body that is liquid-tight relative to the liquid as well as gas-tight can be employed. The basic principle for filling the receptacle resides in that first the balloon-type body is introduced into the receptacle. The balloon-type body is subsequently inflated with air until it is contacting the inner wall surface of the receptacle. Since in this way the completely inflated balloon-type body completely fills the interior of the receptacle, no air is contained in the receptacle anymore. Subsequently, the air is discharged again from the balloon-type body. In this way, between the balloon-type body and the inner wall surface of the receptacle a gradually increasing space is provided which is filled with the liquid.

Upon filling the receptacle there is the problem that the balloon-type body inflates like a balloon. Conversely, the balloon-type body is contracting again upon discharging the air contained therein. Over time, this periodic inflation and subsequent contraction of the material can lead to signs of wear in the balloon-type body. In an extreme case, this can lead to the balloon-type body becoming leaky and to bursting.

Based on this, it is the object of the invention to provide a device for filling a receptacle with a liquid, intended in particular for consumption, of the aforementioned kind with a low-wear balloon-type body.

SUMMARY OF THE INVENTION

The technical solution is characterized in that the balloon-type body in the initial state prior to inflation is folded about the circumference.

In this way, a device for filling a receptacle with a liquid, intended in particular for consumption, is provided which is distinguished by a low-wear balloon-type body. The gist of this balloon-type body resides in that it is folded about the circumference relative to the longitudinal axis of the receptacle. Due to this folding, the balloon-type body has a greater circumferential length about the circumference in comparison to a balloon-type body that is not folded. This means that about the circumference more balloon material is present with the result that for an elastic balloon material a reduced expansion of the balloon material is sufficient in order to come into contact with the inner wall surface of the receptacle. Since the balloon material however must not expand so much and, subsequently, also must not contract so much, the material is stressed less in this way and the risk of damaging the balloon material is reduced to a minimum.

According to an embodiment, in a first variant the folding, viewed in cross-section relative to the central longitudinal axis of the system, can be embodied to be wave-shaped or zigzag-shaped. Other fold forms are conceivable as long as the circumferential line of the folded balloon-type body is enlarged in comparison to a simple circle.

According to an embodiment, in a second variant the folding in cross-section can be embodied as lobes. This is to be understood in that the folds, viewed in cross-section, are relatively long, wherein the two flap-shaped parts of the lobe in the initial state prior to inflation of the balloon-type body are contacting each other and are folded together. In this context, the lobes do not project radially but, as in an umbrella, are positioned in the folded state on the outer circumference of the balloon-type body.

The folds form basically alternating fold pockets as well as fold peaks. According to an embodiment, it is proposed that the fold pockets as well as—correspondingly—the fold peaks are extending in longitudinal direction of the balloon-type body. In this context, these folds are preferably extending exactly in longitudinal direction between the upper opening of the receptacle and the lower bottom.

An embodiment proposes that upon inflation of the balloon-type body the latter is first unfolded and subsequently expanded. In concrete, this means that upon inflation of the balloon-type body the latter is first unfolding in such a way that no folds are existing anymore. As soon as this state has been reached, the balloon-type body is expanded as a result of the inner elasticity of its material. In receptacles which have a reduced diameter in the opening area compared to the actual body area (as is the case, for example, for bottles), it may however happen that in this opening area a complete unfolding of the balloon-type body does not occur. In this case, the folds are pressed against the inner wall of the receptacle in this opening area.

An embodiment proposes an alternative to this. The difference resides in that the balloon-type body is not expandable. This means that, based on the initial state, the balloon-type body is exclusively unfolded until it assumes its final inflated state with contact on the inner wall of the receptacle.

An embodiment proposes that the outer wall surface of the balloon-type body has a profiling. The advantage resides in that upon inflation of the balloon-type body no partial spaces within the receptacle can be formed that are sealed relative to each other. Upon filling the receptacle, it is thus ensured that upon inflation of the balloon-type body no air bubble-type spaces within the receptacle can be formed between the balloon-type body and the inner wall surface of the receptacle. Upon emptying the receptacle, it is ensured likewise that upon inflation of the balloon-type body no liquid-filled closed-off partial spaces within the receptacle can form between the balloon-type body and the inner wall surface of the receptacle. Therefore, no liquid residue remains within the receptacle. The gist of this embodiment resides thus in that the balloon-type body on its outer wall surface exhibits a special profiling wherein this profiling ensures that upon inflation of the balloon-type body at no location about the circumference of this balloon-type body a sealed barrier is formed which is resting seal-tightly against the inner wall surface of the receptacle. Profiling of the outer wall surface of the balloon-type body ensures indeed that even for a maximally inflated balloon-type body a continuous passage is formed which extends from the area of the bottom of the receptacle up to the area of the top side opening of the receptacle. This continuous passage defines in the broadest meaning a bypass conduit through which, upon filling, the air or, upon emptying, the liquid can flow so that the air or the liquid escapes completely from the bottle. In this way, proper filling or proper emptying of the receptacle is possible without any dead space air or liquid bubbles being able to form that are hermetically sealed from the remaining areas.

According to an embodiment, the profiling is preferably formed by a strip-shaped stay. This strip-shaped stay is formed together with the balloon-type body as one piece and projects past the actual wall surface of the balloon-type body. Thus, when the balloon-type body is inflated, first this strip-like stay will contact the inner wall of the receptacle. Around this contact point or contact line, the actual wall surface of the balloon-type body will then snuggly hug the inner wall of the receptacle. As a result of the special geometric conditions, there always remains however in the area between the stay of the actual wall surface of the balloon-type body an intermediate space or a passage through which the air, upon filling, or the liquid, upon emptying, can flow.

In a preferred embodiment thereof, it is proposed that the stay or stays extend in the fold pockets in the initial state of the balloon-type body prior to inflation. In this context, the fold pockets extend substantially in a straight line from the opening of the receptacle to the bottom. In this context, it is not necessary that each one of the fold pockets is provided with a stay, respectively. Preferably, only some of the pockets are provided with the stays wherein the latter are arranged uniformly distributed about the circumference. The advantage of the arrangement of the stays in the fold pockets resides in that the stay essentially disappears in the respective fold pocket. Accordingly, the stay in the initial state is no longer located on the outer circumference of the balloon-type body. This means as a consequence that the balloon-type body can have a still greater diameter.

An embodiment proposes that fibers are embedded in the plastic material of the balloon-type body. They can be embedded in this context in longitudinal direction of the system or in transverse direction or in a net shape or in an entirely random arrangement. The advantages of these fibers resides in that in case that the balloon-type body does indeed burst, possibly produced broken-off pieces are secured by the fibers. The fibers prevent thus the detachment of balloon shreds. Also, the fibers can impart to the balloon-type body the required sufficient stiffness so that it can be inserted into the receptacle without an additional guide rod or tube. The stiffness of the balloon-type body provided by the fibers takes on the guiding function.

An embodiment proposes that the fibers have a different expansion capacity than the actual material of the balloon-type body. Accordingly, the fibers can be employed in a targeted fashion for shaping in the inflated state of the balloon-type body.

A special embodiment thereof is proposed wherein the fibers are introduced in length direction and comprised of less expandable material; the fibers ensure upon inflation of the balloon-type body that the circumferential expansion is greater than the length extension.

BRIEF DESCRIPTION OF THE DRAWINGS

Embodiments of a device according to the invention for filling a receptacle with a liquid that is intended in particular for consumption will be explained in the following with the aid of the drawings. It is shown therein in.

DESCRIPTION OF PREFERRED EMBODIMENTS

A receptacle 1 in the form of a bottle has a lower bottom 2 as well as an upper opening 3. This receptacle 1 is to be filled with a liquid, i.e., a beverage.

For filling the receptacle 1, a balloon-type body 4 is introduced into this receptacle 1. The balloon-type body 4 can be mounted on a tube or guide rod, not illustrated. This tube or guide rod in and of itself is however irrelevant for the function of the invention. No tube or guide rod may be present just as well. In this case, the inner stiffness of the balloon-type body 4 is great enough that it can be inserted without problems into the opening 3 of the receptacle 1.

Figure 1C:
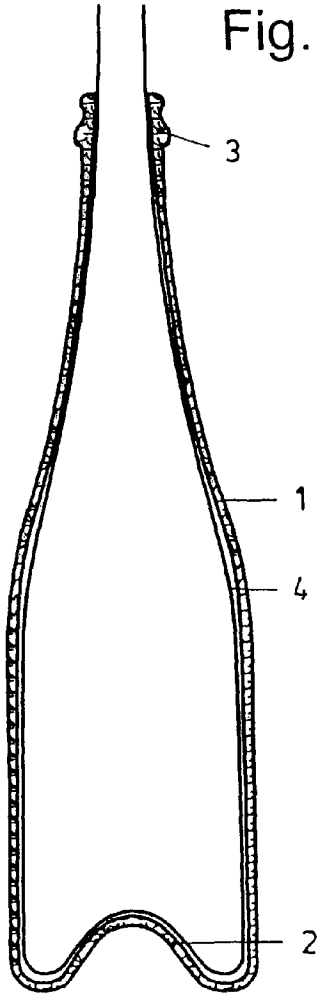
FIG. 1*c* an illustration corresponding to that of FIG. 1*b* in which the balloon-type body is in the expanded final state.
Figure 1B:
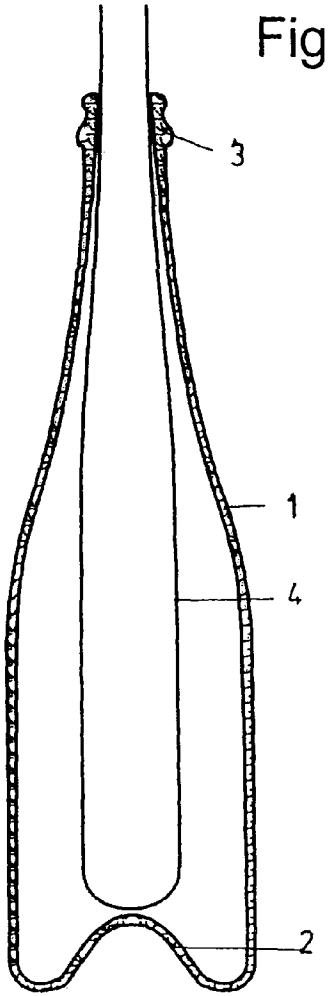
FIG. 1*b* an illustration corresponding to that of FIG. 1*a* in which the balloon-type body is shown in the unfolded but not yet expanded state.
Figure 1A:
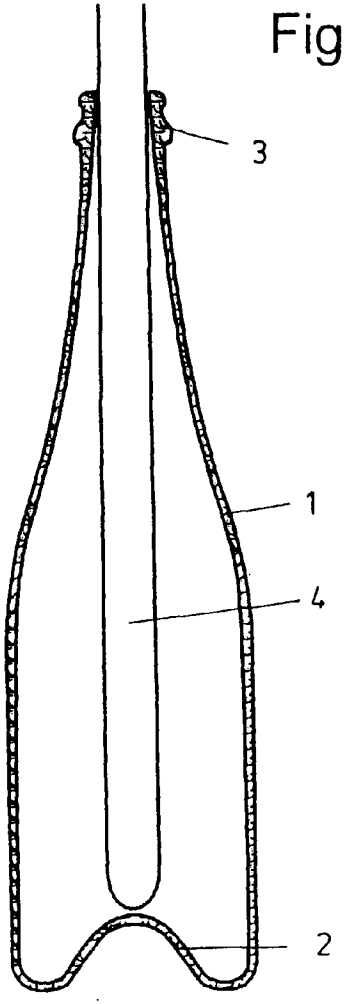
FIG. 1*a* a longitudinal section of the receptacle in the form of a bottle in the basic position.
Figure 2A:
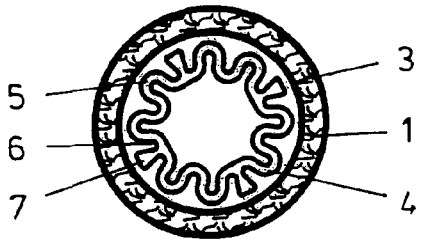
FIG. 2*a* a cross-section of the bottle in the area of the opening.

The special design of the balloon-type body 4 resides in that, in the basic state, it comprises folds 5 about the circumference relative to the central longitudinal axis of the receptacle 1. These folds 5 can be seen in particular in the illustration according to FIG. 2*a* when the balloon-type body 4 is thus inserted through the upper opening 3 into the receptacle 1. In the illustrated embodiment, the folds 5 are embodied to have a wavy shape. In principle, they can also be embodied to be zigzag-shaped or can have a different profiling. It is only decisive that by means of the folds 5 the circumferential length of the balloon-type body 4 is enlarged in comparison to a simple circle circumference.

The folds 5 each comprise fold pockets 6 which extend from the upper opening 3 of the receptacle 1 down to the bottom 2. The special feature in this context is that stays 7 are provided in some fold pockets 6 that are extending in the longitudinal direction and the stays are integrally formed on the material of the balloon-type body 4. In the illustrated embodiment, a total of four of these stays 7 are provided. However, more or fewer stays 7 can be provided also.

As explained above, the balloon-type body 4 is preferably inserted into the receptacle 1 by means of the tube, not illustrated, through the opening 3 into the receptacle 1 and is seal-tightly seated on the opening 3 of the receptacle 1.

Figure 2B:
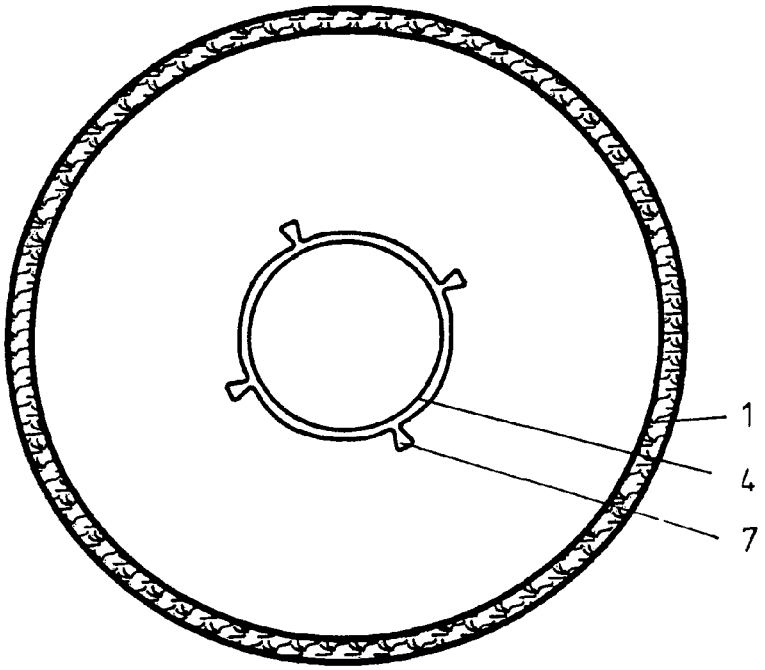
FIG. 2*b* a section of the bottle in the area of the actual bottle body with unfolded but not yet expanded balloon-type body.
Figure 2C:
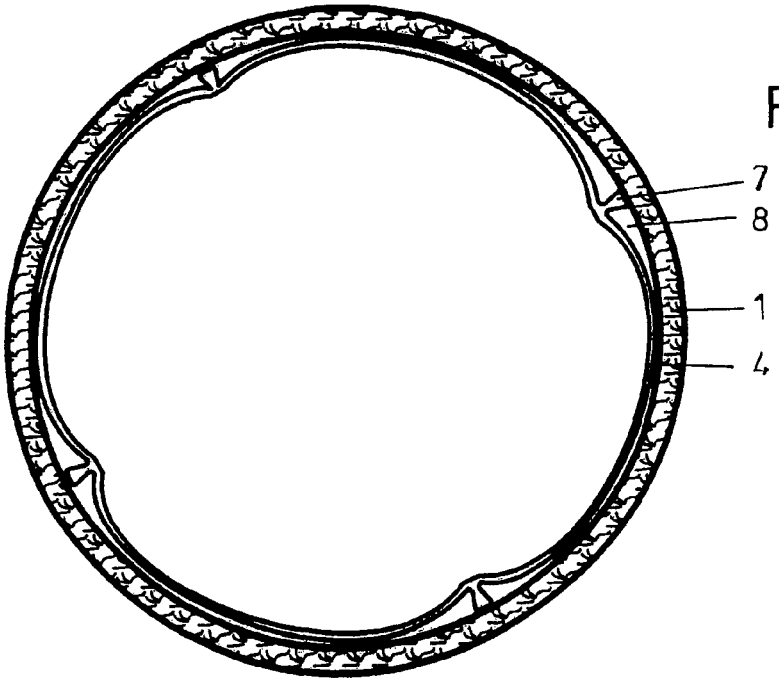
FIG. 2*c* an illustration corresponding to that of FIG. 2*b* in which the balloon-type body is in the expanded state.

Subsequently, the balloon-type body 4 is inflated with an expansion medium, in particular with air. The result of this is that first the balloon-type body 4 with its folds 5 will unfold. This situation is illustrated in FIG. 2*b*. After this unfolding action, the balloon-type body 4 is further inflated. As a result of the elasticity of the balloon-type body 4, the latter will expand like a balloon until it is contacting the inner wall surface of the receptacle 1. This situation is illustrated in FIG. 2*c*. It is furthermore disclosed that passages 8 are formed in the area of the stays 7 between the balloon-type body 4 and the inner wall surface of the receptacle 1. Along these passages 8, air that is present in particular in the bottom area of the receptacle 1 can escape in upward direction.

In this initial state for filling, the expansion medium contained in the balloon-type body 4 is discharged again. In this way, between the balloon-type body 4 and the receptacle 1 an intermediate space is formed which gradually is filled with liquid. The advantage is that the liquid does not come into contact with air. Finally, the balloon-type body 4 is completely pulled out of the receptacle 1 again.

Figure 3:
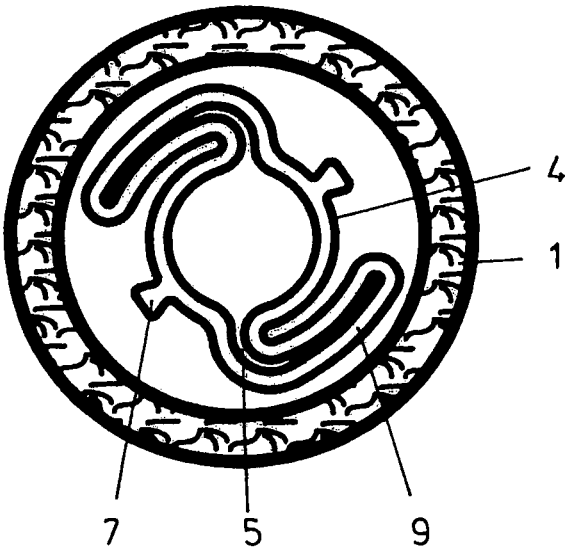
FIG. 3 an illustration in accordance with the illustrations of FIG. 2*a* with a modified folding of the balloon-type body.

In FIG. 3, a second embodiment of the folds 5 of the balloon-type body 4 is illustrated. The difference to the afore described first embodiment resides in that the folds 5, instead of having the wave-shaped or zigzag-shaped structure, are designed as lobes 9. This means that the folds 5 viewed in cross-section define relatively long structures wherein the two flap elements of each lobe 9 in the initial state are resting on each other. Moreover, these lobes 9 are arranged to be supported in the circumferential direction.

In the illustrated embodiment two lobes 9 are provided. In principle, more than two lobes 9 can be provided.

Between the lobes 9, a stay 7 extending in longitudinal direction is provided, respectively.

In this context, the advantage of the folds 5 in the form of lobes 9 resides in that the circumferential length is enlarged in comparison to the wavy or zigzag form of the folds 5. Preferably, in this context the inner stiffness of the material of the balloon-type body 4 is such that after discharge of the expansion air the balloon-type body 4 automatically returns into its initial state, illustrated in FIG. 3.

Moreover, it is also conceivable that the two afore described embodiments can be combined with each other, i.e., a portion of the folds 5 are wave-shaped or zigzag-shaped and another portion of the folds 5 are embodied in the form of lobes 9.

In principle, the afore described system is usable also for emptying the receptacle 1. The situation in this context would then be as follows:

A liquid is contained in the receptacle 1. The liquid is to be conveyed out of the receptacle 1. For this purpose, the balloon-type body 4 is inserted and gradually inflated with air. In this way, the liquid which is contained in the receptacle 1 is pushed out of the upper opening 3.

Here also the balloon-type body 4 is initially unfolded with respect to its folds 5. After unfolding, the balloon-type body 4 expands like a balloon. Here also it is ensured by means of the passages 8 that liquid can be pushed completely out of the receptacle 1.

After complete emptying of the receptacle 1, the balloon-type body 4 is pulled out again and can be used for emptying another receptacle 1.

LIST OF REFERENCE CHARACTERS

1 receptacle
2 bottom
3 opening
4 balloon-type body
5 fold
6 fold pocket
7 stay
8 passage
9 lobe

What is claimed is:

1. A device for filling a receptacle with a liquid that is intended in particular for consumption, the device comprising:

a balloon-type body that is liquid-tight relative to the liquid and is gas-tight;

the balloon-type body insertable into an opening of the receptacle and securable on or in the opening of the receptacle after complete insertion;

after complete insertion, the balloon-type body is fillable and inflatable with an expansion medium such that the balloon-type body contacts an inner wall surface of the receptacle in an inflated state of the balloon-type body;

the balloon-type body, in an initial state of the balloon-type body prior to inflation, comprises folds that are folded in a circumferential direction of the balloon-type body, wherein the folds have fold pockets that extend in a longitudinal direction of the balloon-type body;

wherein the balloon-type body comprises an outer wall surface with a profiling, wherein the profiling is configured such that, in the inflated state of the balloon-type body, a continuous passage is formed extending from a bottom of the receptacle up to the opening of the receptacle, wherein through the continuous passage, upon filling of the receptacle, air contained in the receptacle can flow out or, upon emptying of the receptacle, liquid contained in the receptacle can flow out;

wherein the profiling comprises strip-shaped stays formed as one piece together with the balloon-type body, wherein the strip-shaped stays are projecting past a wall surface of the balloon-type body and wherein the strip-shaped stays extend from the bottom of the receptacle up to the opening of the receptacle;

wherein the strip-shaped stays each extend in one of the fold pockets of the folds in the initial state of the balloon-type body prior to inflation.

2. The device according to claim 1, wherein the folds are folded in a wavy shape or a zigzag shape, viewed in a cross-section of the balloon-type body.

3. The device according to claim 1, wherein the folds, viewed in a cross-section of the balloon-type body, are embodied as lobes that are arranged so as to rest against an outer circumference of the balloon-type body.

4. The device according to claim 1, wherein the balloon-type body is comprised of an elastically expandable material and, upon inflation of the balloon-type body, the folds of the balloon-type body are initially unfolded and subsequently the elastically expandable material of the balloon-type body is expanded.

5. The device according to claim 1, wherein the balloon-type body is comprised of a non-expandable material and, upon inflation, the folds of the balloon-type body are unfolded.

6. The device according to claim 1, wherein the balloon-type body is comprised of a plastic material and of fibers embedded in the plastic material.

7. The device according to claim 6, wherein the fibers have an expansion capacity that is different from an expansion capacity of the plastic material.

8. The device according to claim 7, wherein the fibers are comprised of a material that is less expandable than the plastic material and the fibers extend substantially in an axial direction of the balloon-type body.

* * * * *